US006701585B2

(12) United States Patent
Tsaur

(10) Patent No.: US 6,701,585 B2
(45) Date of Patent: Mar. 9, 2004

(54) STOP DEVICE FOR UPPER STOPS AND A PULL OF A NYLON ZIPPER

(76) Inventor: Chang-Wen Tsaur, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/212,373

(22) Filed: Jul. 31, 2002

(65) Prior Publication Data

US 2004/0020018 A1 Feb. 5, 2004

(51) Int. Cl.[7] ..... A44B 19/36
(52) U.S. Cl. ..... 24/436; 24/435
(58) Field of Search ..... 24/436, 433, 435, 24/432, 427, 434, 415, 418, 419

(56) References Cited

U.S. PATENT DOCUMENTS 4,667,377 A * 5/1987 Akashi et al. ..... 24/436
4,752,992 A * 6/1988 Kondo et al. ..... 24/436
2002/0116798 A1 * 8/2002 Okada et al. ..... 24/433

* cited by examiner

*Primary Examiner*—Anthony Knight
*Assistant Examiner*—André L. Jackson

(57) ABSTRACT

A stop device for upper stops and a pull of a Nylon zipper has an upper stop formed by a left stop and a right stop; a pull being installed on one end of a zipper strip. The upper end surfaces and the bottom of the left stop and right stop are formed with protruded stop blocks, and the pull has a left and a right teeth channel, tops or bottoms of a respective teeth channel are formed with stop grooves. When the left stop and right stop enter into the two teeth channels of the pull, the left stop and right stop enter into the stop grooves. Since the stop blocks are resisted against the stop grooves, the left stop and right stop are buckled in the pull. Moreover, the left stop and right stop have the function of preventing the pull from separating from the zipper strips.

5 Claims, 6 Drawing Sheets

STOP DEVICE FOR UPPER STOPS AND A PULL OF A NYLON ZIPPER

FIELD OF THE INVENTION

The present invention relates to zipper elements, and particularly to stop device for upper stops and a pull of a Nylon zipper.

BACKGROUND OF THE INVENTION

A zipper with an upper stop is disclosed. In that, the upper stop is formed by a left stop and a right stop which are formed at an upper end and interior of the zipper teeth. The stops are rectangular and has a U-like cross sections. The left stop and right stop can enter into the two upper teeth channels of a pull of the zipper and are engaged with the engaged zipper teeth to be arranged as a Y shape. The defect of this prior art is that the pull is easily separated from the left stop and right stop automatically.

Thereby, the inventor of the present invention discloses a zipper in which stop blocks are protruded from tops or bottoms of the upper stops for resisting the pull so that the pull can not separate from the left stop and right stop. But in this prior art, the stops are placed out of the pull (i.e., can not enter into the upper teeth channels of the pull) and the stops are too sharp so that it is possible to hurt people. Moreover, the stop is used in steel zippers instead of Nylon zippers.

No positioning pin is used in mold-injecting the bottoms of the stops, the thickness of the stops are not uniform, because no positioning pin is used to support the zipper strips, the melt plastic can not flow into the bottom of the stops. Thereby, the effect of the product is bad.

SUMMARY OF THE INVENTION

Accordingly, the primary object of the present invention is to provide a stop device for upper stops and a pull of a Nylon zipper has an upper stop formed by a left stop and a right stop; a pull being installed on one end of a zipper strip. The upper end surfaces and the bottom of the left stop and right stop are formed with protruded stop blocks, and the pull as a left and a right teeth channels tops or bottoms of which are formed with stop grooves. When the left stop and right stop enter into the two upper teeth channels of the pull, the left stop and right stop enter into the stop grooves. Since the stop blocks are resisted by the stop grooves, the left stop and right stop are buckled in the pull. Moreover, the left stop and right stop have the function of preventing the pull from separating from the zipper strips.

The various objects and advantages of the present invention will be more readily understood from the following detailed description when read in conjunction with the appended drawing.

DETAILED DESCRIPTION OF THE PREFERRED EMBODIMENTS

Figure 1:
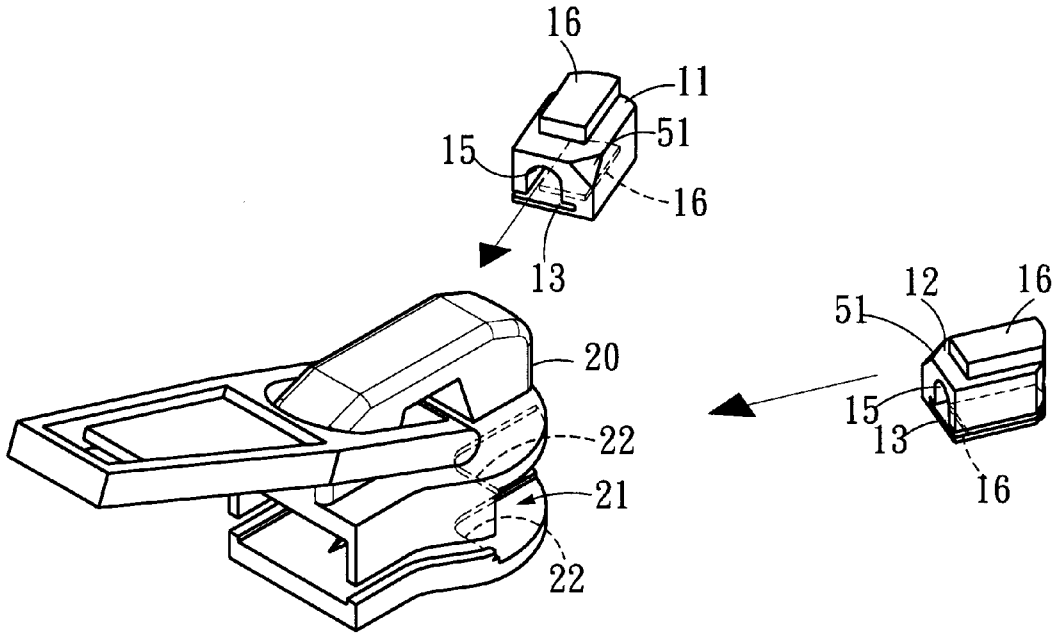
FIG. 1 is an exploded schematic view showing the upper stops and pull of the zipper according to the present invention.
Figure 2:
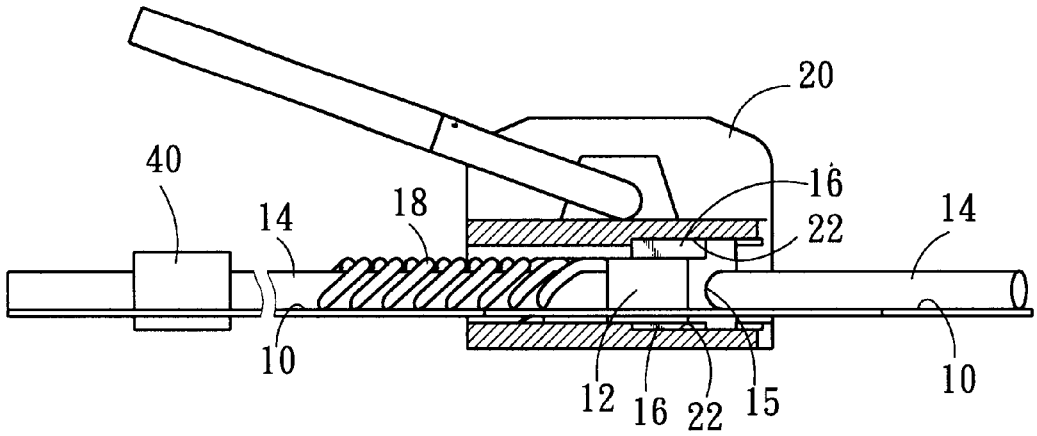
FIG. 2 is a cross sectional view showing the assembled upper stop and pull in FIG. 1.

Referring to FIG. 1, an exploded perspective view of the upper stop and pull of the present invention is illustrated. FIG. 2 shows the assembled view of the upper stop and the pull. It is illustrated that the upper stop is formed by a left stop 11 and a right stop 12. Each of the left stop 11 and right stop 12 is formed by a long stop and a short stop and is positioned at upper ends of the two banks of the zipper teeth 18 and an inner lateral side of the two zipper strips 10. Each of the left stop 11 and right stop 12 has a slit 13 and a through hole 15 for receiving seamed lines 14 (referring to FIGS. 2 and 4). The slit 13 and through hole 15 are formed after the upper stop is formed by injection.

The feature of the present invention is that the upper end surfaces and the bottom of the left stop 11 and right stop 12 are formed with protruded stop blocks 16. Respectively, the pull 20 has a left and a right teeth channel 21 the top or bottom of a respective teeth channel are installed with stop grooves 22. The stop blocks 16 and the stop grooves 22 are engageable. An opening of each stop grooves 22 extends into an interior of the teeth channels.

Another feature of the present invention is that the upper edges of lower elements of the left stop 11 and right stop 12 are chamfered to have tilt guide surfaces 51, preferable, they are chamfered with a 45 degree angles. When the left stop 11 and right stop 12 are guided into the pull 20, they will not be buckled with the middle isolating blocks, teeth channels 21 and stop grooves 22, etc. Thereby, the left stop 11 and right stop 12 are easily guided into the pull 20. Since the tilt guide surface is not found in the prior art upper stop (including steel zippers or nylon zippers). Thereby, when the two stops are guided into the pull 20 obliquely, they are buckled and resisted by the pull. This will make the user's feel uneasy. If the zipper is used for a longer time, it easily damages.

Figure 3:
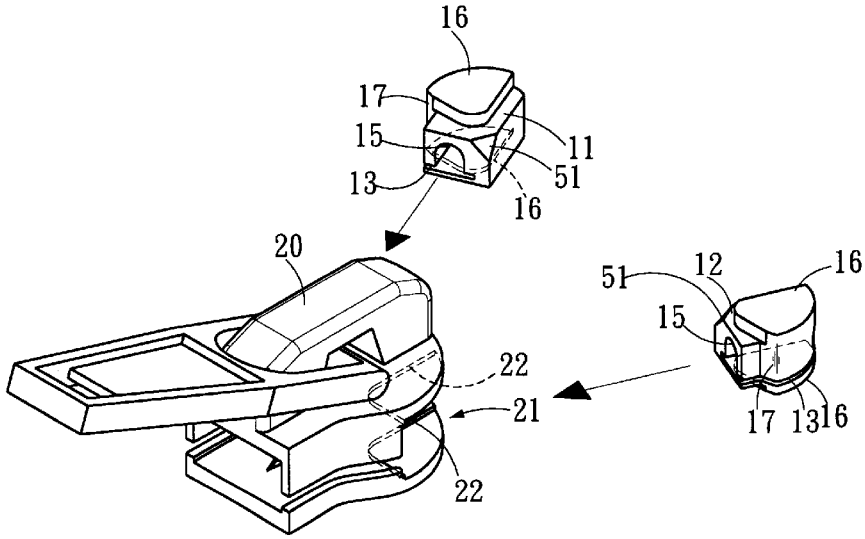
FIG. 3 is an exploded schematic view showing the upper stop and the pull in another embodiment of the present invention.

Referring to FIG. 3, the left stop 11 and right stop 12 are formed with buckles 17. The buckles 17 and the stop blocks 16 have dual effects of stopping. The buckles 17 resist against the two lateral walls of the upper teeth channels 21 (referring to FIG. 5 and the stop blocks 16 resist against the stop grooves 22).

Figure 4:
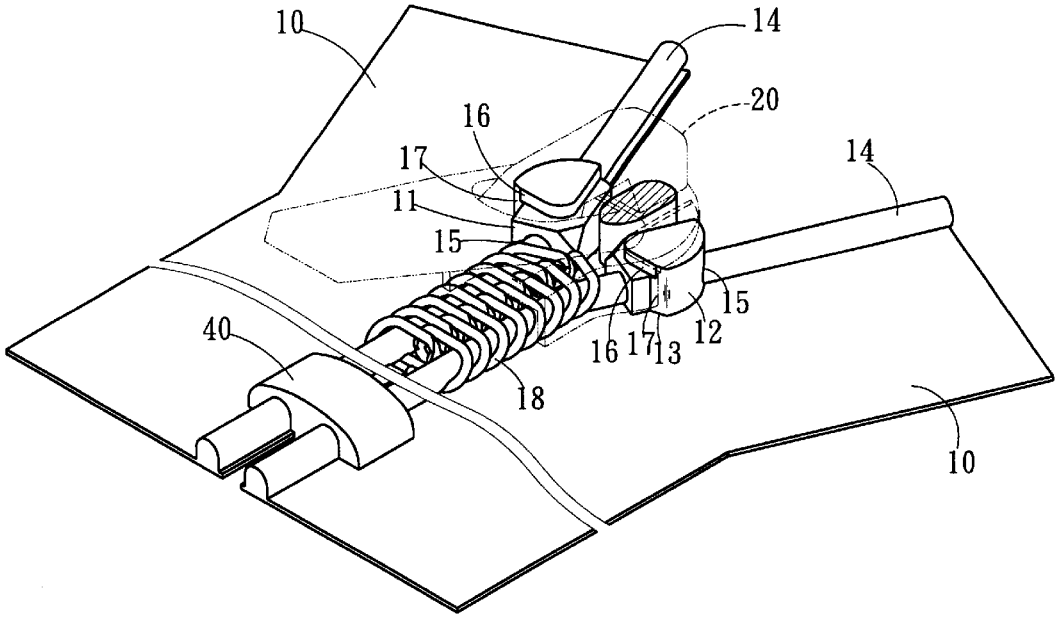
FIG. 4 is a perspective view showing that the upper stop is used with pull of FIG. 3.
Figure 5:
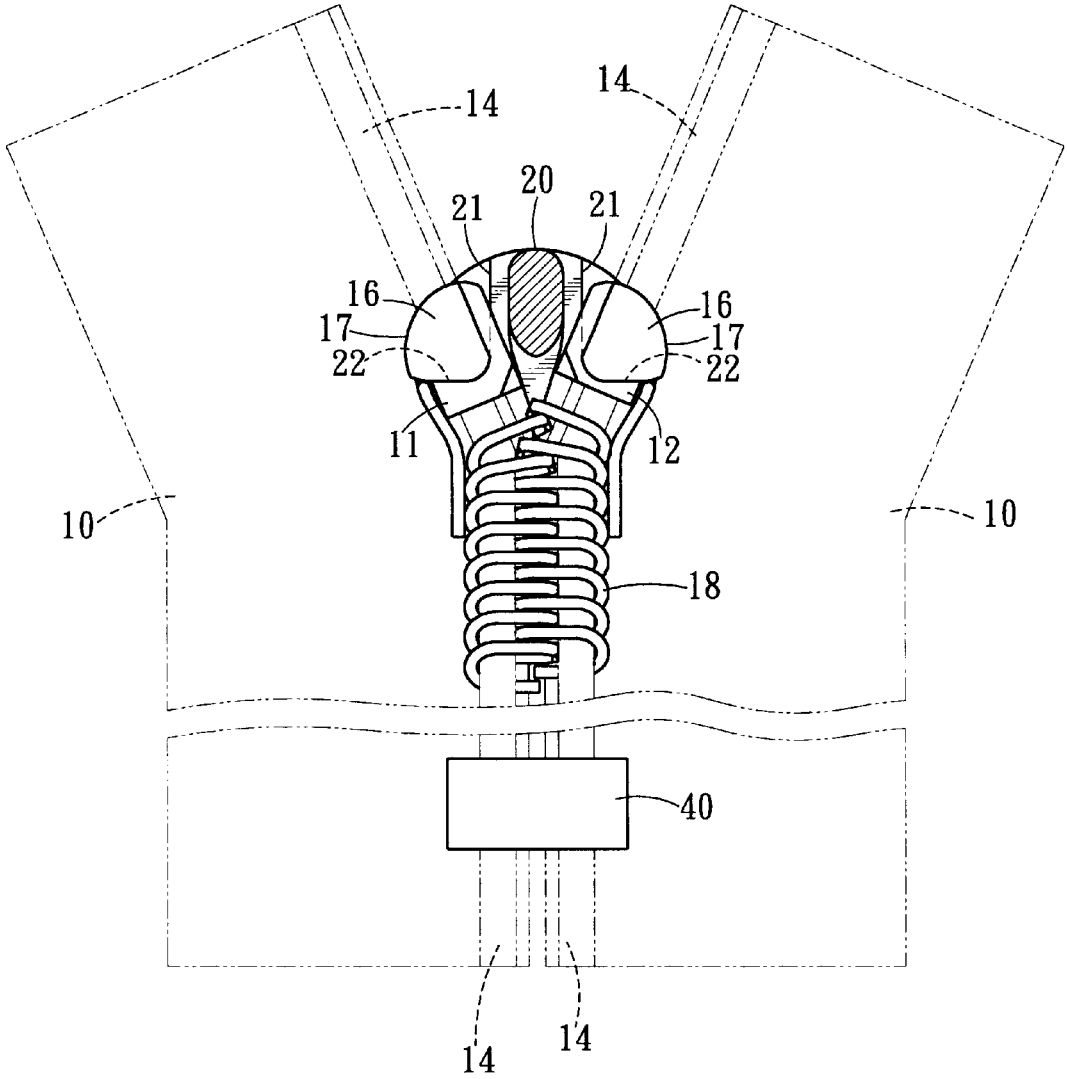
FIG. 5 is an elevational view showing that the upper stop is coupled to the pull of FIG. 3.

Referring to FIGS. 4 and 5, the buckle 17 has been used in the prior art and thus the details thereof will not be further described herein. After the left stop 11 and right stop 12 enter into the two upper teeth channels 21 of the pull 20, the stop blocks 16 enter into the stop grooves 22. Since the stop blocks 16 are resisted by the stop grooves 22, the left stop 11 and right stop 12 are positioned and buckled to the upper teeth channels 21 and thus can not further enter into the pull 20. Moreover, the pull 20 resists by the stop blocks 16 of the left stop 11 and right stop 12 and can not separate from the upper stop.

Figure 6:
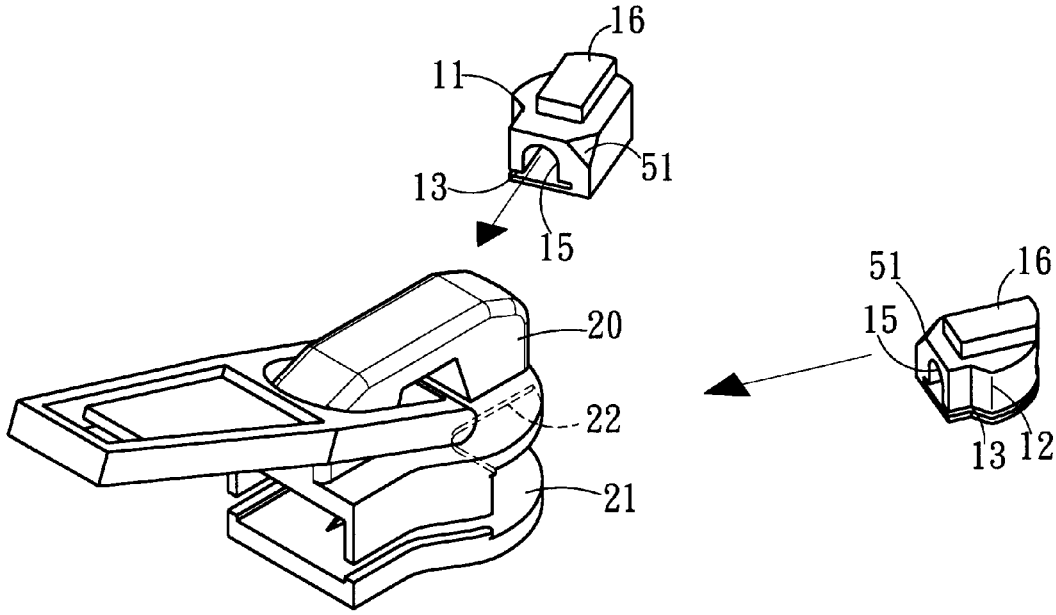
FIG. 6 is an exploded schematic view showing the zipper and the pull in another embodiment of the present invention.
Figure 7:
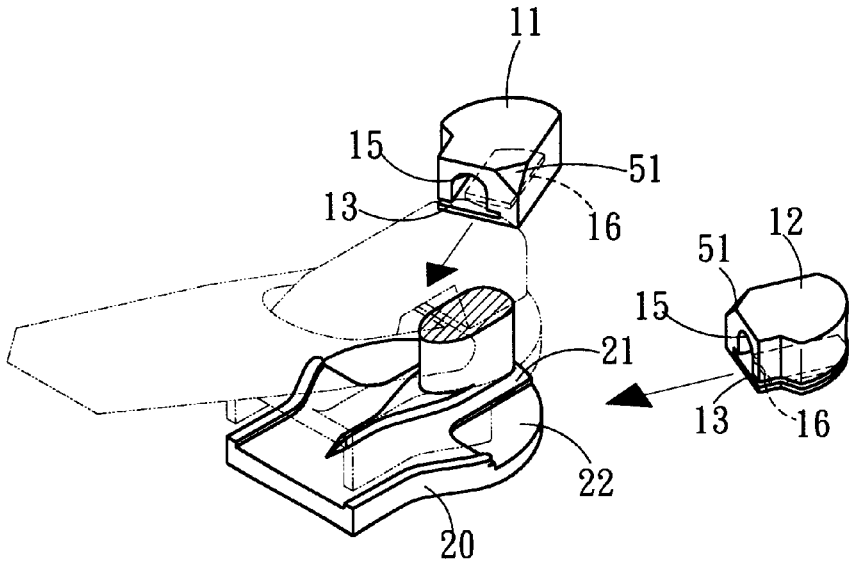
FIG. 7 is an exploded perspective view showing the upper stop and the pull in a further embodiment of the present invention.

Referring to FIGS. 6 and 7, two further embodiments of the present invention are illustrated. In FIG. 6, other than the buckles 17, the tops of the left stop 11 and right stop 12 have stop blocks 16 which have rectangular shapes. The tops of the upper teeth channels 21 have stop grooves 22. In FIG. 7, the left stop 11 and right stop 12 have stopping elements and bottoms thereof have stop blocks 16. The bottoms of the upper teeth channels 21 have stop grooves 22 for matching the stop blocks 16.

Figure 8A:
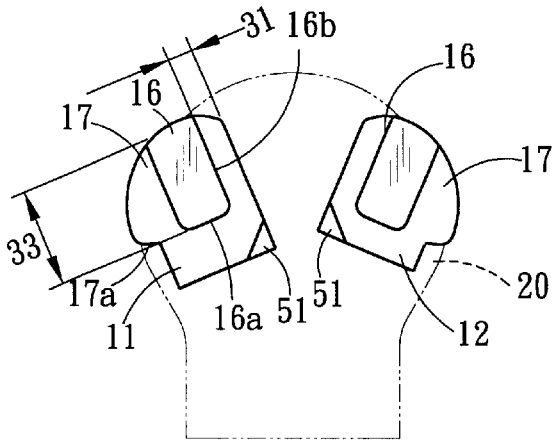
FIGS. 8A to 8C is a schematic view showing the embodiment of the upper stop of the zipper of the invention.
Figure 8B:
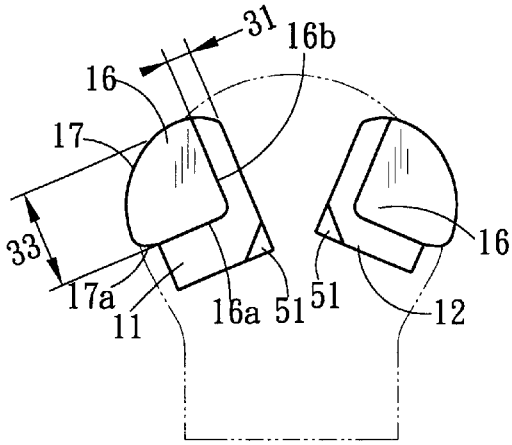
Figure 8C:
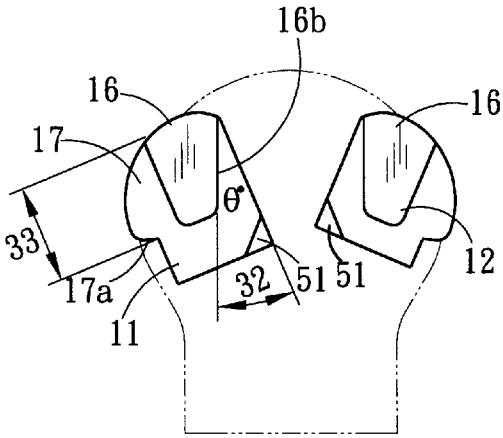

In above example, the sizes of the stop blocks 16 and stop grooves 22 are approximately identical. But two features must be taken care in design. With reference to FIGS. 8A to 8C, an inner lateral sides 16*b* of stop blocks 16 are straight or tilt. If they are straight, see FIG. 8A, a gap 31 is formed with the inner lateral side of the stop. If it is tilt, see FIG. 8C, the stop blocks 16 have an angle θ° 32 with the inner side of the stops. The gap 31 and tilt angle 32 casue the upper stop to displace into the stop grooves 22 when the upper stop is guided into the pull 20. If no gap or tilt angle is formed, the stop blocks 16 easily touch the front edge of the pull 20 and the middle isolating block. Moreover, the lengths 33 of the stop blocks 16 and buckles 17 are preferably identical. That is, the lower edge 16*a* of the stop block 16*a* is flushed with the lower edge 17*a* of the buckle 17. Thereby, they can be resisted by the outer wall and stop groove of the pull 20. Thereby, the upper stop suffers from a uniform force. In FIG. 8C, the stop blocks 16 are flushed with the buckles 17 so that the stop blocks 16 have larger area.

Figure 9:
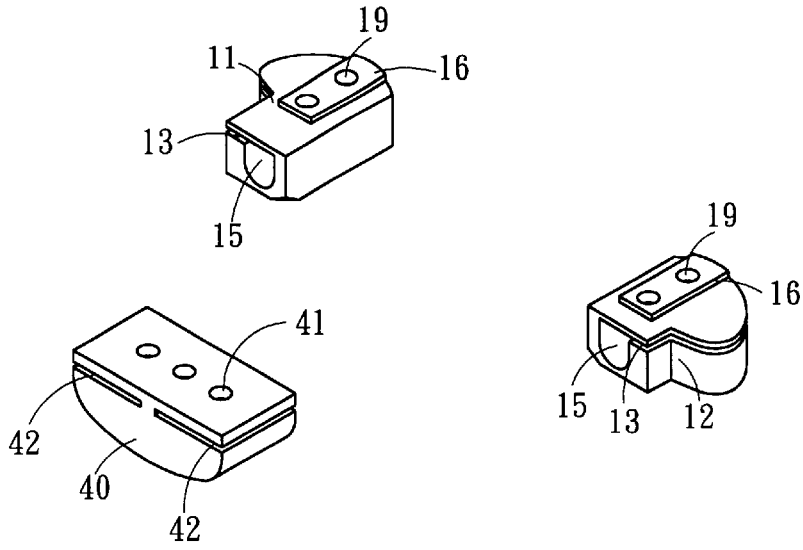
FIG. 9 is a bottom view about the upper stop and lower stop of the present invention.

Referring to FIG. 9, the bottom views of the upper and lower stops are illustrated. It is illustrated that the left stop 11 and right stop 12 of the upper stops have a U-like shape. The lower stop 40 has an H-like shape. The left and right sides of the lower stop 40 have slits 42 for clamping the zipper strips. The bottoms of the left stop 11, right stop 12 and lower stop 40 have at least one positioning holes 19, 41. When the left stop 11, right stop 12 and lower stop 40 are formed by mold-injection, the zipper strips are installed with positioning pins (not shown) for forming the positioning holes. The positioning holes are used to support the zipper strips 10. Thereby, the plastic material can flow into the bottoms of the zipper strip so as to form the bottoms of the stops. Otherwise, the bottom with a width of 0.5 mm will have non-uniform thickness since the width of the bottom is approximately 0.5 mm. The positioning pins are not used in the prior art molding injection technology. Thereby, the bottoms of the upper stop and lower upper stop are not uniform so that they easily crack.

Figure 10:
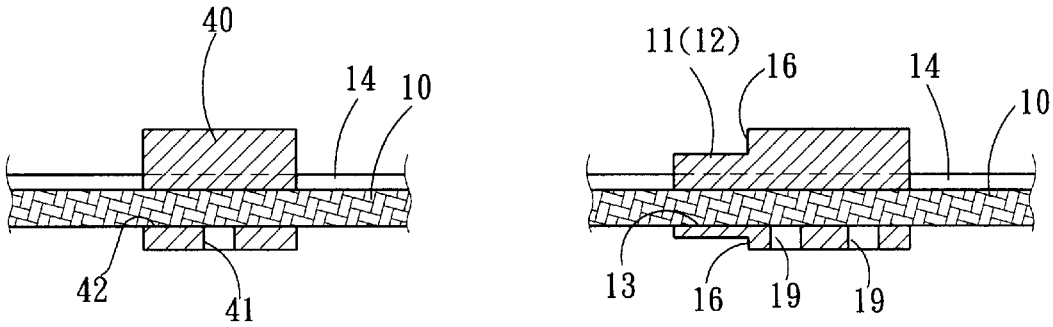
FIG. 10 is a cross sectional view showing that the upper stop, lower stop of the zipper are combined.

Referring to FIG. 10, the cross sectional views showing that the left stop 11, right stop 12 and lower stop 40 are combined with the zipper strip 10. The positioning holes 19, 41 are formed from the bottoms to the zipper strips. After the positioning holes are formed, the strain can be removed when the thermal setting plastics is formed. Thereby, the strains due to the material and temperature differences of the zipper strip are released and the plastic stops can be released. The design of the positioning holes is not used in the prior art.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A stop device for upper stops and a pull of a Nylon zipper; the upper stop being formed by a left stop and a right stop; a pull being installed on one end of a zipper strip; characterized in that:

upper end surfaces and the bottom of the left stop and right stop being formed with protruded stop blocks, and the pull has a left and a right teeth channel, tops or bottoms of a respective teeth channel are formed with stop grooves; the stop blocks and the stop grooves are engageable;

wherein when the left stop and right stop enter into the left and right teeth channels of the pull, the left stop and right stop enter into the stop grooves; since the stop blocks are resisted by the stop grooves, the left stop and right stop are buckled in the pull; and, the left stop and right stop have the function of preventing the pull from separating from the zipper strips.

2. The stop device for upper stops and a pull of a Nylon zipper as claimed in claim 1, wherein an outer lateral side of the left stop and right stop are formed with respective buckles for resisting against the pull.

3. The stop device for upper stops and a pull of a Nylon zipper as claimed in claim 1, wherein one side of each stop block is straight and reduced from a corresponding side of a corresponding left stop and right stop.

4. The stop device for upper stops and a pull of a Nylon zipper as claimed in claim 1, wherein one side of each stop block is tilt and reduced from a corresponding side of a corresponding left stop and right stop.

5. The stop device for upper stops and a pull of a Nylon zipper as claimed in claim 1, wherein a length of each stop block is equal to a length of each buckle.

* * * * *